US005088419A

United States Patent [19]

Hartwell et al.

[11] Patent Number: 5,088,419

[45] Date of Patent: Feb. 18, 1992

[54] TABLES

[76] Inventors: Clive R. Hartwell, 17 Loch Bay, Waternish, Isle of Skye, Great Britain, IV55 8GD; David W. Hartwell, 156 Coventry Road, Market Harborough, Leicestershire, Great Britain, LE16 9DA

[21] Appl. No.: 435,397

[22] PCT Filed: May 13, 1988

[86] PCT No.: PCT/GB88/00379

§ 371 Date: Nov. 13, 1989

§ 102(e) Date: Nov. 13, 1989

[87] PCT Pub. No.: WO88/08681

PCT Pub. Date: Nov. 17, 1988

[30] Foreign Application Priority Data

May 13, 1987 [GB] United Kingdom ..... 8711250

[51] Int. Cl.[5] ..... A47B 1/00

[52] U.S. Cl. ..... 108/66; 108/112

[58] Field of Search ..... 108/63, 67, 62, 66, 108/112

[56] References Cited

U.S. PATENT DOCUMENTS 2,654,647 10/1953 Murry .

FOREIGN PATENT DOCUMENTS 0366112 12/1922 Fed. Rep. of Germany ..... 108/63

1028025 2/1953 France .

6788 of 1835 United Kingdom ..... 108/66

*Primary Examiner*—Kenneth J. Dorner

*Assistant Examiner*—Gerald A. Anderson

*Attorney, Agent, or Firm*—Breiner & Breiner

[57] ABSTRACT

A table including a top and a base each consisting of a plurality of hingedly connected sections so that the surface area of the table top as well as the base thereof can be varied by folding or unfolding the plurality of respective sections. The hingedly connected top sections include two quadrant sections and four octant sections wherein each of the top sections are hinged on both sides to adjacent sections thereby allowing the formation of ridge folds and valley folds during the folding and unfolding of the table top sections.

10 Claims, 10 Drawing Sheets

TABLES

FIELD OF THE INVENTION

This invention relates to tables.

BACKGROUND OF INVENTION AND DESCRIPTION OF RELATED ART

Tables in which the effective area of the table surface can be varied are well known. Dining tables have been produced for many years provided with a base and one or more additional leaves which may be put adjacent table top sections to give a bigger table top. When not used, they may be slid under the table top (draw leaf tables) or may be removed altogether for storage separately. An alternative approach is to hinge the table top e.g. into two or three sections, one section being supported by a framework from which a support arm, optionally including a floor engaging leg, may be extended to support the folded up section. Such gate-leg tables are produced in a variety of designs. They possess a major disadvantage that when the section or sections are in their folded down position, they constitute a vertical wall e.g. making it difficult to sit with one's knees under the table if one sits at the folded down side. This is unsatisfactory.

Folding hinged table tops are known which consist of two sections hinged together which may either rest one on top of another in turn on top of the base, or where the other one may be hinged about its hinged line with the other piece of the table top to bring them into a common plane, which is then supported by the same underlying framework. The unfolded table top may be swivelled about a vertical axis to ensure that both halves are supported on the underlying framework. Because the framework does not change its shape, when the table top is unfolded, support is sometimes inadequate and the table is unstable. Also, tables with a top consisting of a number of equal sized hinged sections which may be unfolded to form an extended top and folded in for storage are known, for example from German Patent Specification, DE-C-366112, French Patent Specification, FR-A-1028025 and U.S. Pat. No. 2,654,647.

BRIEF DESCRIPTION OF INVENTION

According to the present invention there is provided a table consisting of a top and a base, the top consisting of a number of hinged sections which may be folded between a position in which the sections are co-planar to a position in which the sections are superimposed forming a two- or multi-layer top, the base being likewise foldable from an extended position in which it supports the unfolded table top to a retracted position in which it supports the folded assembly of superimposed table top sections, characterised in that the hinged sections comprise two quadrant sections and four octant sections.

By means of the combination of the change in shape of the support base to match the unfolding and expanding area constituted by the table top, tables may be produced which are stable both in their low surface area folded form and in their high surface area extended form.

The shape of the table top when in its most extended flat arrangement may vary. It may be for example square, non square but rectangular, circular or oval.

Other shapes may also be used, though they are less usual.

A particularly preferred way of dissecting the extended table surface into a plurality of table sections is by two cuts at right angles which intersect at the centre of the extended surface, and a third cut likewise passing through the intersection between the first two, and bisecting the angle between the other two cuts. Such a dissection dissects a circle into two quadrants and four octants. If the lines separating each section from the next are considered as hinge lines, forming the lines between two adjacent octants into ridge folds and the remaining lines into valley folds will start to fold the table top into a folded four layer configuration with the four octants between the two quadrants.

If the same dissection is used with a right angled isosceles triangle, the folded out configuration is a square table. If attached to the hypotenuse of each of the two isosceles right angled triangles having their right angle at the centre of the unfolded table top there is added a rectangle, then the folded out shape is also a rectangle. If instead of an arc of a circle of radius that of the straight side of the quadrant, the quadrant is circumscribed by a curve, for example, circular arc of greater or lesser radius of curvature, petalled shapes may be produced when the table top is unfolded. The centre of the curvature of an arc of greater radius of curvature may lie outside the table itself, so giving re-entrant sides to the table.

According to the folding arrangement of each embodiment of the table top, appropriate hinges are used between adjacent sections so that ridge and valley folds as mentioned previously can be achieved.

In all cases in accordance with the invention the table top is supported on a base which is likewise foldable from a relatively closed position in which it supports the folded table top to a relatively open position in which it supports the unfolded table top, in each case substantially over its entire area. Using the two quadrant/four octant dissection and its variants noted above, a very convenient way of forming the base is to form it as a number of frame sections hinged together about one or more essentially adjacent vertical axes located essentially under the centre of the unfolded table or at an angled, suitably right angled, corner of the table when it is folded up, the frame sections forming an underframe to support the table top.

In a particularly preferred table construction in accordance with the invention, the underframe consists of a plurality of subframes each hinged for rotation about a substantially vertical axis, the assembly being foldable from a position in which they are distributed through a relatively small angular range, e.g. 90° about the vertical axis, to a position in which they are equally spaced through 360° about that axis.

Preferably at least two subframes have set in their upper edge means which can be rotated to run non-radially relative to the central axis, most preferably essentially normal to a radius extending from the central axis. Such members may constitute transverse surface supports substantially improving the overall stability of the unfolded extended table surface.

The underframe and table top may be separable if desired, enabling easy and compact storage of the table when not in use. Indeed, the underframe and top may be wholly separate, the top simply resting on the underframe. However, for stability, the top of the frame and the underside of the folding table top may have cooperating means enabling them to be held together. Such means may include sliding track means enabling the position of one of the table top sections to be varied relative to parts of the underframe. This can avoid problems with overlap when the table and underframe are in their folded positions. Suitable catch mechanisms may be incorporated e.g. magnetic or mechanical catches to hold the table top and/or underframe in folded or unfolded positions.

One arrangement for retaining the table top sections in an unfolded position is to utilise a recessed bolt housed in one section and which can be engaged with a recess formed in an adjacent section when the two sections are substantially coplanar.

The underframe can be retained in its unfolded position by using a locking arm which extends between two adjacent subframes. This arm may comprise a single rigid piece or may comprise two portions hinged together and to the subframes at each free end. In the latter case, locking means, for example an internally mounted spring loaded block which engages both portions or an external sleeve which covers the hinged joint between the two portions, can be provided.

The tables according to the present invention can be made in a variety of materials using conventional techniques. Thus they may be made of metal, wood or plastics, and different materials may be used for the underframe and for the top. One underframe may have several alternative shape tops for assembly therewith as desired

BRIEF DESCRIPTION OF DRAWINGS

The invention is illustrated by way of example with reference to the accompanying drawings in which.

DESCRIPTION OF PREFERRED EMBODIMENTS

Figure 1:
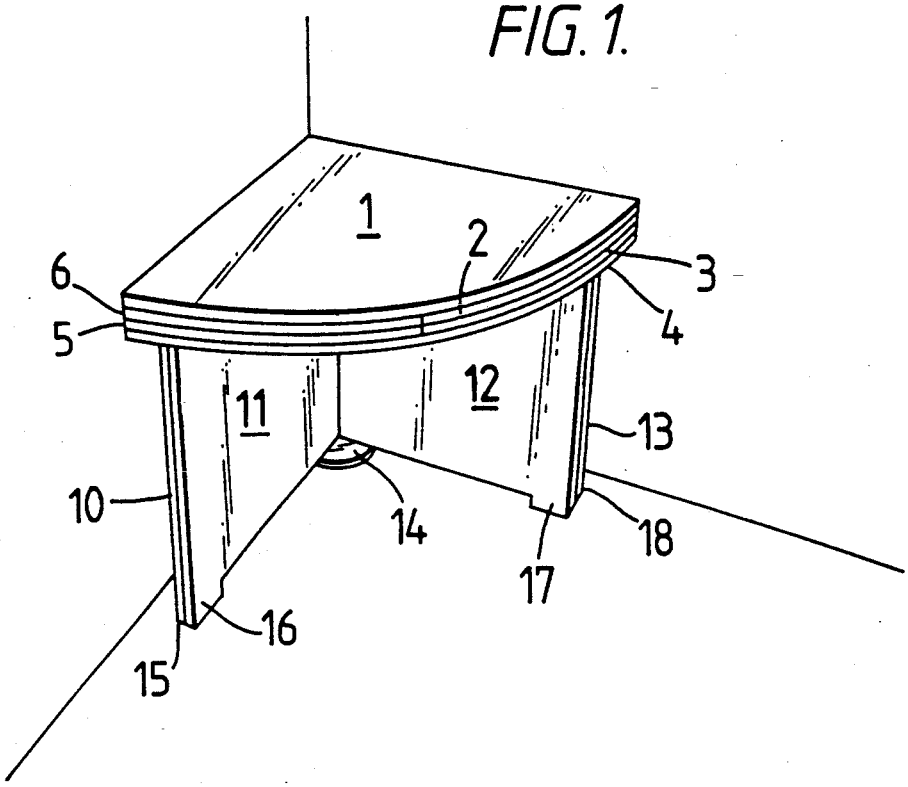
FIG. 1 is a perspective view of a table in accordance with the invention, set in a room corner.
Figure 2:
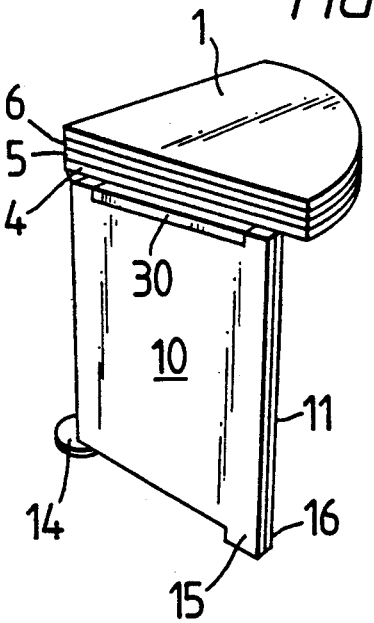
FIG. 2 is a view of the table of FIG. 1 from a different angle.
Figure 3:
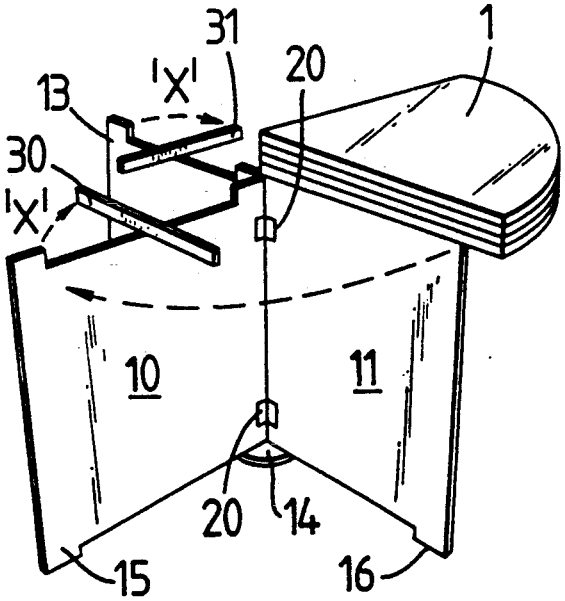
FIG. 3 is a perspective view of the table of FIG. 1 during its erection from being a quadrant shaped table to being a circular table.

Referring first to FIGS. 1 to 3 these show a quadrant shaped corner table consisting of a table top 1 and an underframe consisting of two pairs of plates 10, 11 and 12, 13 supporting it. Between table top section 1 and the underframe (constituted by plates 10, 11, 12, 13) are located other table top sections 2, 3, 4, 5 and 6.

Plates 11 and 12 are rigidly fixed with respect to one another at an angle of 90° on a central foot 14, with plate 13 being hinged to plate 12 and plate 10 to plate 11, both by means of hinges 20. This enables plates 10 and 13 to be swung away from plates 11 and 12 respectively to form a generally cruciform arrangement shown also in FIGS. 4 and 5. Set on the upper edges of plates 10 and 13 are swivellable support arms 30 and 31 which can be swung about their centres as indicated by arrows 'X' in FIG. 3 so that they lie transversely across the tops of plates 10 and 13. Each plate has a respective foot portion 15, 16, 17, 18 formed at a lower corner away from the central foot 14.

Figure 5A:
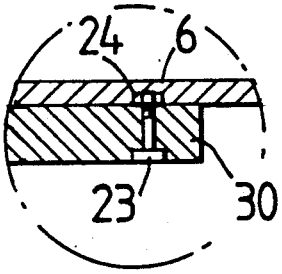
FIG. 5*a* shows an enlarged section through the pivoting bar illustrating a nut/bolt arrangement.
Figure 5:
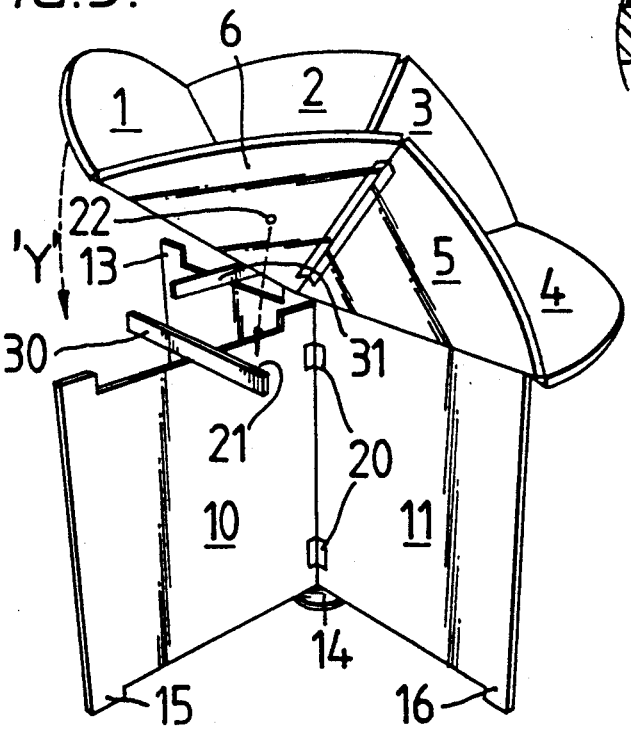
FIG. 5 shows the table top in a more unfolded position.

As shown in FIG. 5, the ends of bars 30 and 31 may each include a recessed magnet 21 which cooperates with an associated recessed keeper 22 in the respective table top portion. Alternatively, as shown in FIG. 5*a*, the bar 30 may have a transverse hole through which a fixing screw or bolt 23 may be passed, and which engages with a nut 24 retained in the table top portion. Naturally other appropriate means can be utilised so that the ends of the bars 30, 31 cooperate with what becomes the underside of the unfolded table top.

Figure 4:
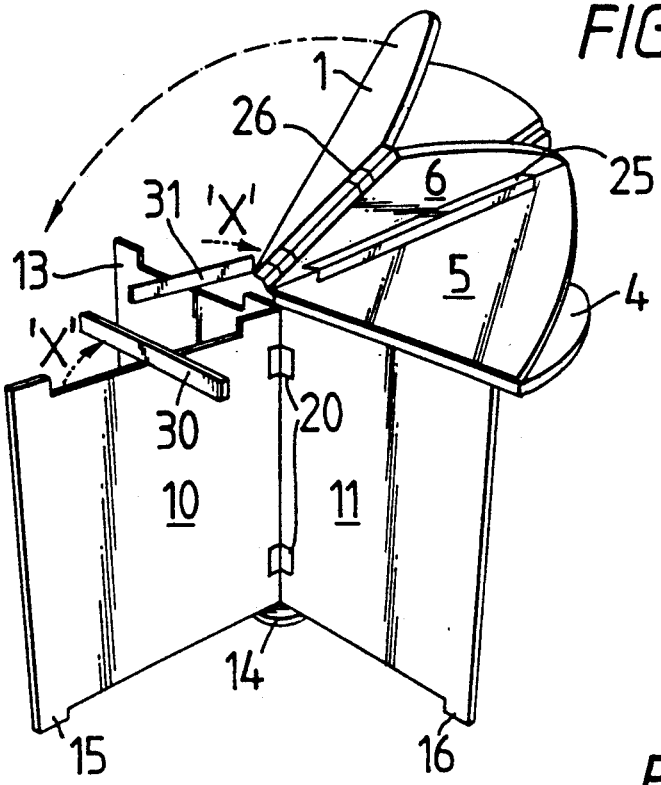
FIG. 4 is a diagram similar to FIG. 3 and showing the table top as unfolding commences.
Figure 6:
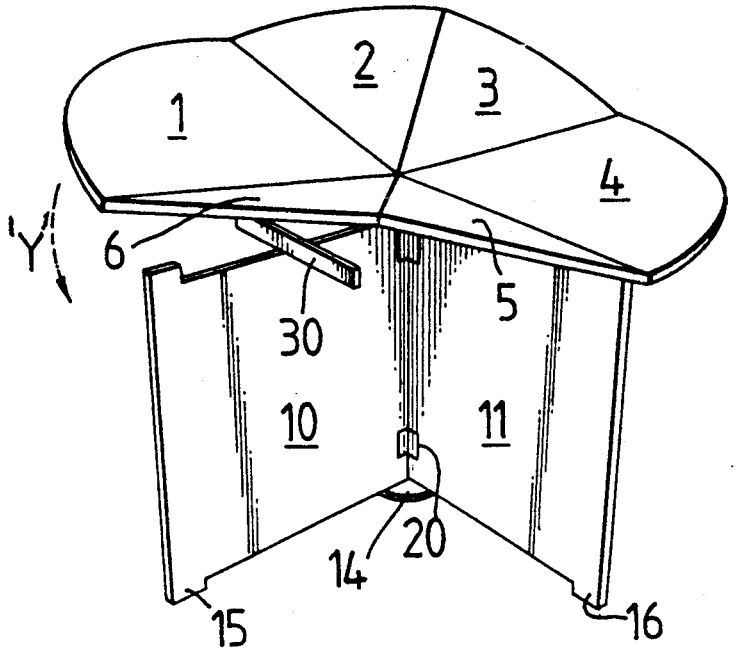
FIG. 6 shows the table top almost in its completely unfolded position.
Figure 7:
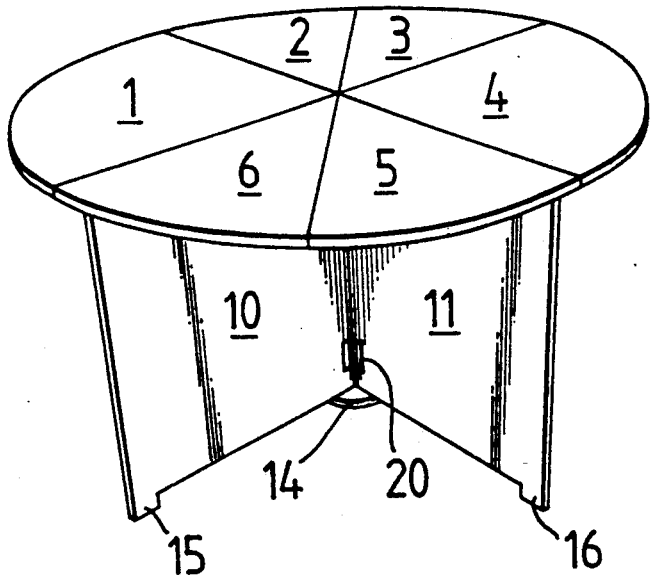
FIG. 7 shows the circular table resulting therefrom.
Figure 8:
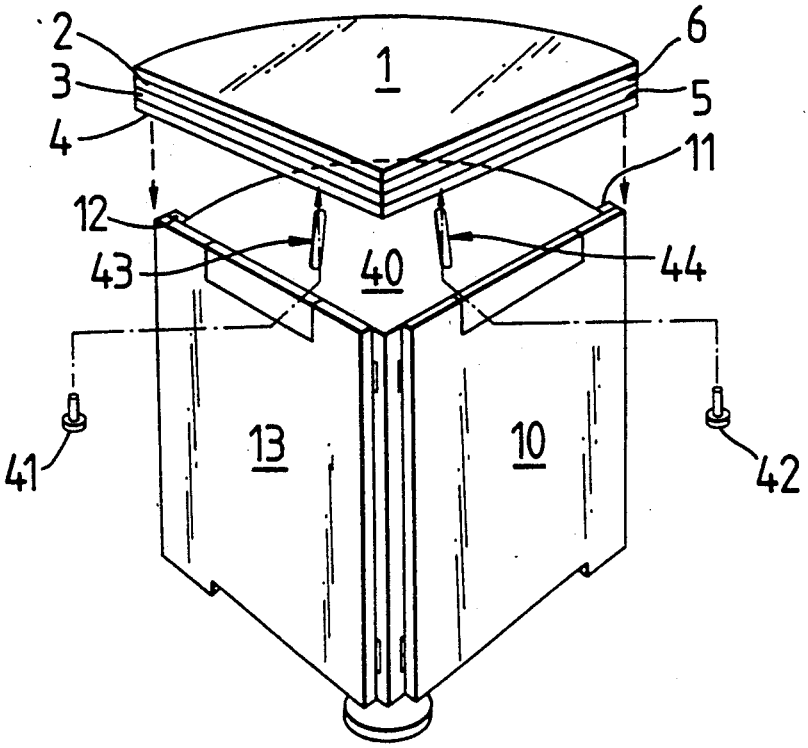
FIG. 8 shows an alternative quadrant shaped table.
Figure 9:
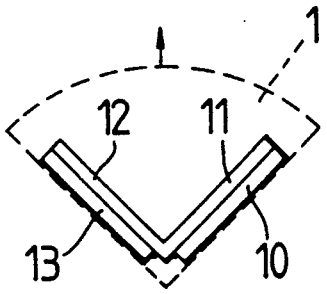
FIGS. 9, 10 and 11 are diagrammatic views showing how the base of the table of FIG. 8 is unfolded.
Figure 10:
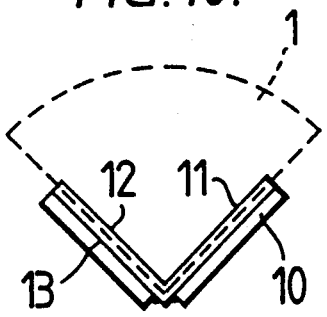

Turning now to consideration of the table top, this is shown in its fully folded position in FIGS. 1, 2 and 3. Once the plates 10, 11, 12, 13 have been folded out to shape as shown in FIGS. 3 and 4, lifting quadrant 1 starts to unfold the sections constituting the table top. As quadrant 1 is lifted, it moves as shown in FIG. 4 in direction of arrow 'Y'. Further movement in the direction of arrow 'Y' as shown in FIGS. 5 and 6 further unfolds the table until it finally comes to rest as shown in FIG. 7. It will be seen that FIG. 7 constitutes an erected folding circular table of radius that of the quadrant 1.

The sections constituting the table top are hinged together to allow the folding and unfolding operations to be executed. A piano hinge 25 may conveniently be used between sections such as 5 and 6 as shown in FIGS. 4 and 5 to form ridge folds, i.e. between sections which are folded to bring their undersides together. Between sections which are folded to bring their uppersides together to form valley folds, a hinge 26 which allows such folding without being present on the uppersides of the sections may be used i.e. between sections 1 and 6 as shown in FIG. 4.

The sequence of folding the table in the shape shown in FIG. 1 is simply the reverse of the unfolding sequence just explained.

Figure 11:
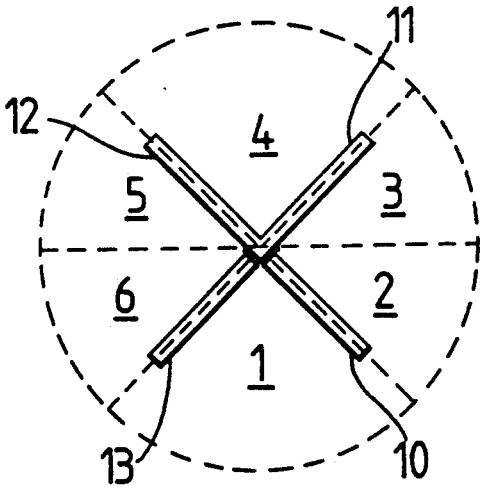

FIGS. 8 to 11 indicate a variant where the assembly of quadrant and octant sections 1 to 6 sit on a quadrant shaped land 40 which extends between the top edges of plates 11 and 12. The underside of quadrant 4 is held captive against quadrant 40 by means of two sliding pins 41, 42. The quadrant 40 has two slots 43, 44 through which the pins 41, 42 extend to engage the underside of the quadrant section 4. The free movement allowed by this connection enables the folded quadrant shaped table top to be pushed firmly in to lie snugly in a corner as shown in FIG. 1 (and as shown in diagrammatic top view in FIG. 9) but to be moved, when it is desired to move the table top out to be a circular table top, to the position shown diagrammatically in FIG. 10. When the table is folded out to circular shape from that position, the table top is supported totally symmetrically by the four plates, as shown in FIG. 11, the quadrant and octant divisions being shown by dotted lines. The slots 43, 44 may extend to the arcuate edge of the quadrant and each have a spring loaded movable catch which engages projections on the underside of quadrant 4.

Figure 12:
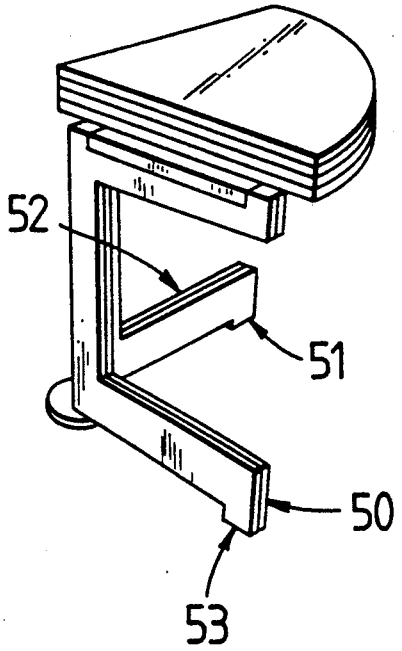
FIGS. 12 and 13 are perspective views of a further embodiment having cantilever arms supporting the table top sections, in folded and partly unfolded positions respectively.
Figure 13:
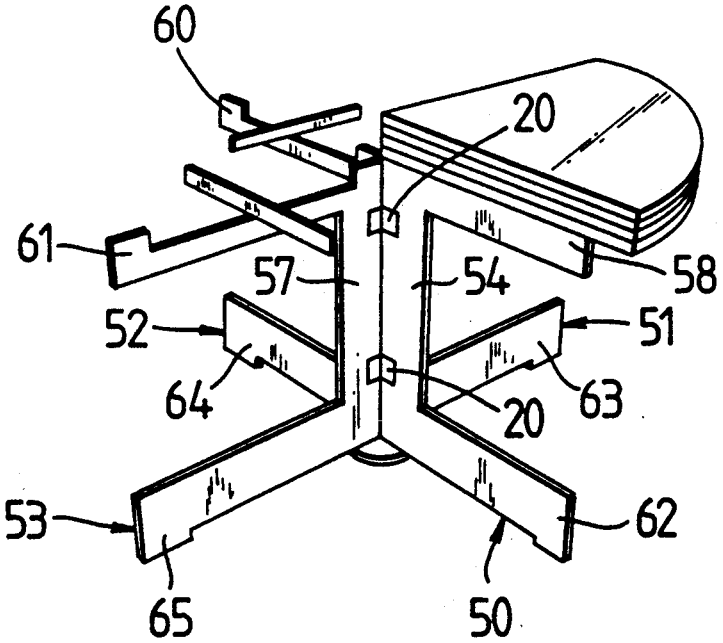

FIGS. 12 and 13 show a similar construction save that instead of the plates 10, 11, 12, 13 the underframe consists basically of four "C" shaped members 50, 51, 52, 53 hinged together. For each member 50, 51, 52, 53 the vertical portion 54, 55, 56, 57 of each member forms part of a central support pillar, respective upper horizontal parts 58, 59, 60, 61 a cantilevered support arm for a portion of the table top, and respective lower portions of the "C" 62, 63, 64, 65 a horizontally extending cantilevered foot.

Figure 14:
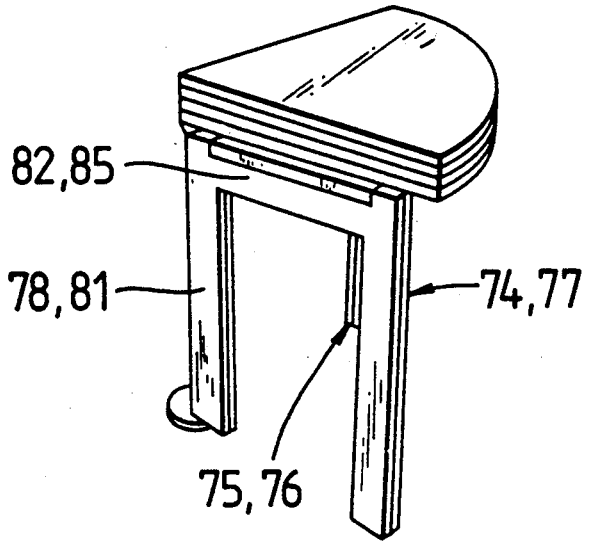
FIGS. 14 and 15 are Figures corresponding to FIGS. 12 and 13 but of a further alternative embodiment.
Figure 15:
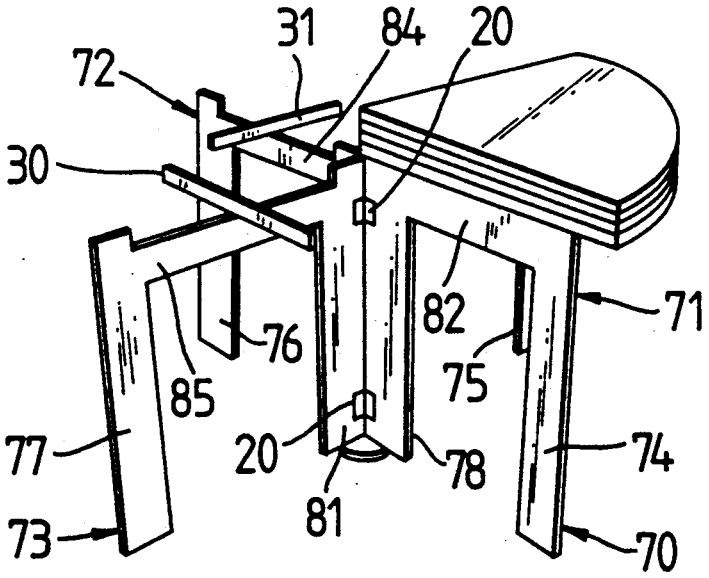

FIGS. 14 and 15 show a further embodiment of the underframe of the table. As shown the plates 10, 11, 12, 13 are replaced by portal members 70, 71, 72, 73, each of which has a front leg 74, 75, 76, 77, a rear leg 78, 79, 80, 81, and a cross rail 82, 83, 84, 85. As before, the portal members 72, 73 are foldable out, and each carries a bar 30, 31 in their respective cross rails 84, 85 which fold out to support the table top.

Figure 16:
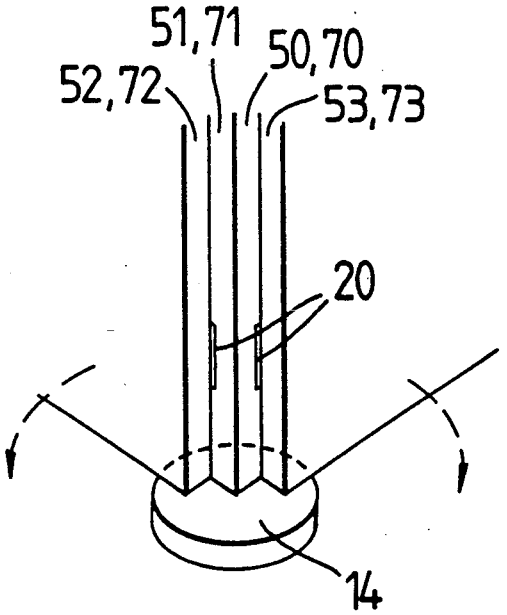
FIGS. 16 17 and 18 are details showing the unfolding of the underframe of the table shown in FIGS. 12 to 15, FIGS. 19 to 21 illustrate a further embodiment of the underframe with means for locking the unfolded underframe.
Figure 17:
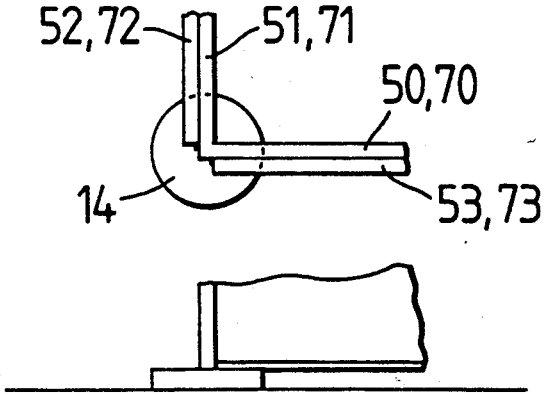
Figure 18:
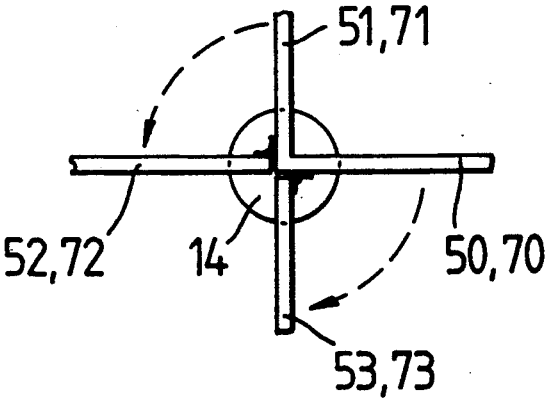
Figure 19:
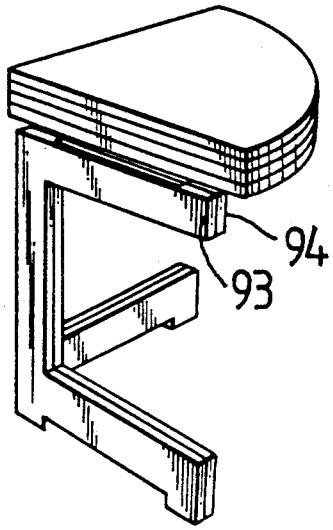
Figure 20:
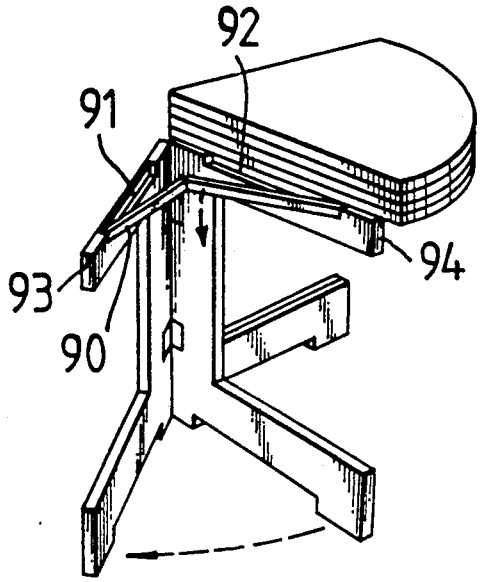
Figure 21:
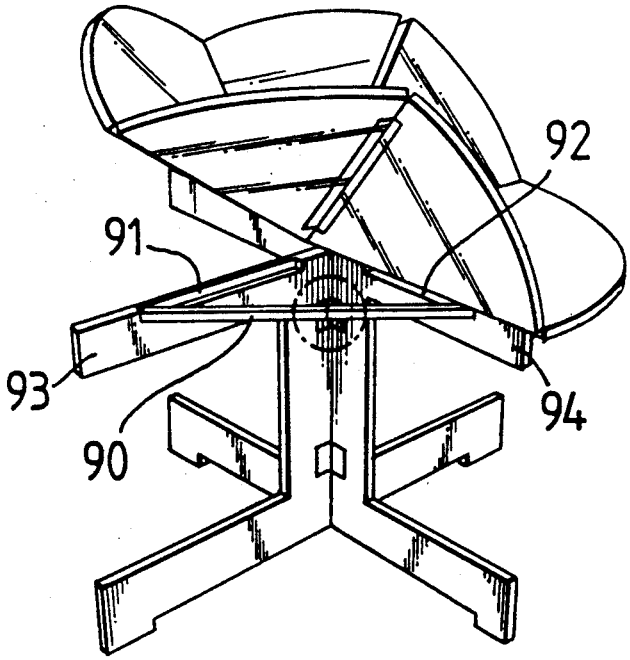

FIGS. 16 to 18 illustrate the unfolding of the underframe of the table shown in FIGS. 12 to 15. The members 50, 70 and 51, 71 are fixed to the foot 14 and the other members 52, 72 and 53, 73 are hinged with respect to one of the fixed members. It is to be noted that such an arrangement is not limited to the underframe of FIGS. 12 to 15, and can be used with other underframes.

FIGS. 19 to 22 illustrate a further embodiment of the underframe with means for locking the unfolded underframe. In this embodiment, the bars 30, 31 are replaced by a hinged spring loaded locking arm 90 which when folded fits into a recess 91, 92 formed in respective ones of the support members 93, 94 which although shown as being "C" shaped members, may be of any of the other forms described previously.

Figure 22:
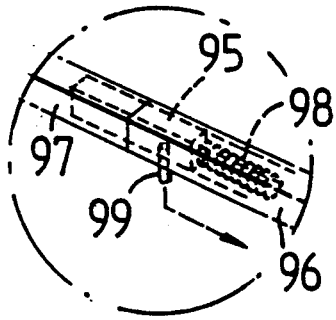
FIG. 22 is an enlarged view of the spring loaded locking mechanism circled in FIG. 21, FIGS. 23 and 24 illustrate an arrangement for locking two adjacent octant sections together.

The locking mechanism as shown in more detail in FIG. 22, comprises a block 95 mounted inside one portion 96 of the arm 90 and which is biased to extend into the other portion 97 of the arm by a spring 98. During movement of the arm 90 to the locked position (FIG. 21) the block 95 can be retracted by means of a pin 99, to allow the portions 96, 97 to become axially aligned. Similarly, to unlock the arm 90, the pin 99 can be moved to disengage the block 95 from the position 97.

Figure 23:
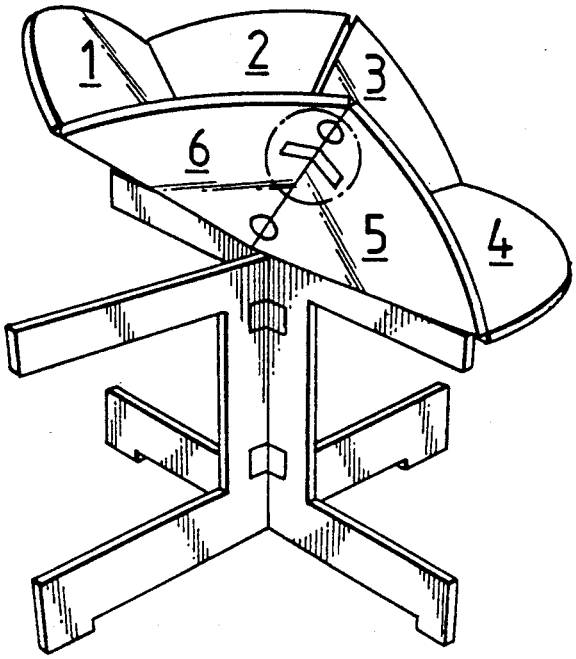
Figure 25:
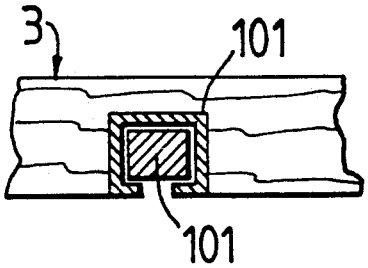
FIG. 25 is an enlarged detail of the bolt of FIGS. 23 and 24, and FIGS. 26 and 27 illustrate a further arrangement of locking of the underframe in a cruciform embodiment.
Figure 24:
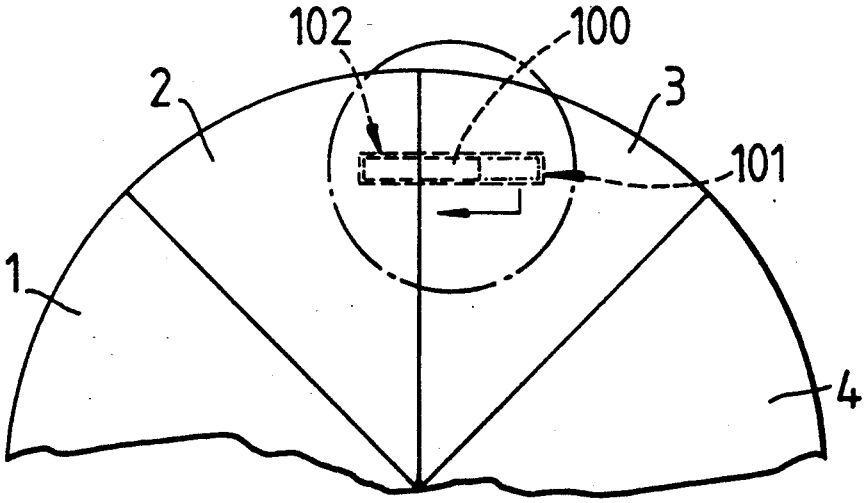

FIGS. 23 to 25 show an arrangement for locking two adjacent octant sections together. As the quadrant sections 1 and 4 are supported at their straight sides by the underframe, the pairs of octants section 2, 3 and 5, 6 can be locked together by a movable stud 100 which is retained in a recess formed in each of octants 3 and 6. The stud 100 is then moved to engage a shallower recess 102 in each of octants 2 and 5 to lock these sections together when they are coplanar and when the recesses 101, 102 are coaxial.

Figure 26:
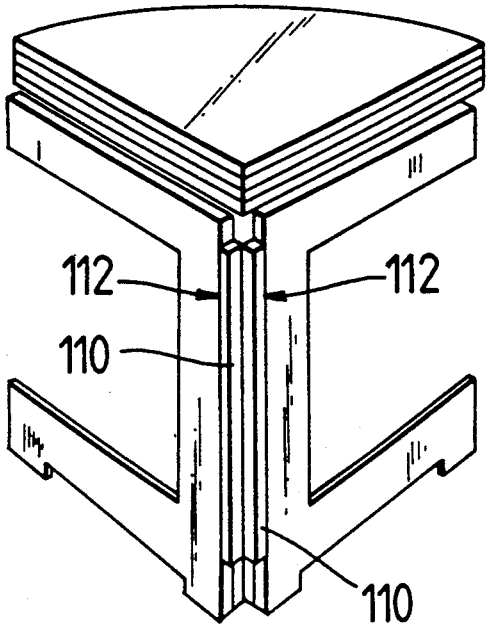
Figure 27:
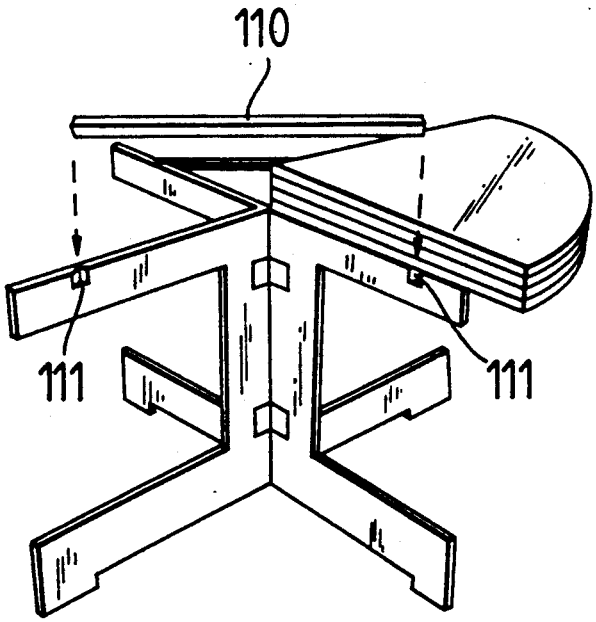

FIGS. 26 and 27 illustrate another embodiment of locking of the underframe. The support members may be of any of the previously described forms but each has a slot 111 to receive ends of a bar 110 which spaces the support members in a cruciform arrangement. When not in use, i.e. when the table is folded, the bars 110 can be stored in recesses 112 formed in the vertical column of the underframe as shown.

As an alternative to the locking arm embodiment of FIGS. 19 to 22, the block 95 can be replaced by a sleeve on the outside of the portion 96 which is pushed over the joint between portions 96 and 97 to lock the arm 90. If a spring is required, it is then positioned around the portion 96 instead of inside it. However, it should be noted that a spring is not necessary in this alternative as the sleeve can easily be moved from one position to the other by hand.

We claim:

1. A table consisting of a top and a base, the top consisting of a plurality of hingedly connected sections capable of being folded between a first position in which the sections are coplanar to a second position in which the sections are superimposed to form a top having at least two layers, and the base consisting of a plurality of hingedly connected sections capable of being folded from an extended position in which the base supports the top in said second position to a retracted position in which the base supports the top formed of the superimposed sections, wherein the hingedly connected sections of the top comprise two quadrant sections and four octant sections with each of said quadrant and said octant sections being hinged on both sides to adjacent sections, said octant sections being present in adjacent pairs, and the hinged sides between said octant sections of each of said pairs forming ridge folds and the remaining hinged sides forming valley folds when said quadrant and said octant sections are folded from said first position to said second position.

2. A table according to claim 1 wherein the sections of the top are arranged such that the two quadrant sections are diametrically opposed.

3. A table according to claim 1 wherein the plurality of hingedly connected sections forming the base are connected at one or more essentially adjacent vertical axes located essentially under the center of the table when the hingedly connected sections of the top are in said first position and the hingedly connected sections of the base are in said extended position.

4. A table according to claim 3, wherein the one or more essentially adjacent vertical axes are located at a corner of the table when the hingedly connected sections of the top are in said second position and the hingedly connected sections of the base are in said retracted position.

5. A table according to claim 3 or 4 wherein each section of the base is hinged for rotation about a substantially vertical axis, the base being foldable from a position in which the base sections are distributed through substantially 90° about the vertical axis, to a position in which the base sections are equally spaced through 360° about that axis.

6. A table according to claim 3 or 4 wherein at least two of the base sections have set in their upper edges a means which can be rotated to run non-radially relative to the central axis, to constitute transverse surface supports for the extended table top.

7. A table top according to claim 1 wherein a top portion of each of said base sections and an underside portion of each of said top sections have cooperating means enabling said base sections and said top sections to be held together.

8. A table according to claim 8 wherein the cooperating means includes a sliding track attachable to said table top and a means present in said base sections for engaging the sliding track to thereby enable the position of the top sections to be varied relative to said base sections.

9. A table according to claim 1 wherein the top sections are retained in said first position by means of a recessed bolt housed in one of said top sections which can be engaged with a recess formed in an adjacent top section when the two top sections are substantially co-planar.

10. A table according to claim 1 wherein the base is retained in said first position by a locking arm extending between two adjacent base sections.

* * * * *